US010629349B2

(12) United States Patent
Naftali et al.

(10) Patent No.: US 10,629,349 B2
(45) **Date of Patent: *Apr. 21, 2020**

(54) FLEXIBLE MAGNETIC SEALING APPARATUS

(71) Applicant: Gooper Hermetic Ltd., Michmoret (IL)

(72) Inventors: Philip Naftali, Michmoret (IL); Izik Moalem, Moshav Adanim (IL)

(73) Assignee: GOOPER HERMETEIC LTD. (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/670,557

(22) Filed: Oct. 31, 2019

(65) Prior Publication Data

US 2020/0075209 A1 Mar. 5, 2020

Related U.S. Application Data

(60) Division of application No. 15/972,981, filed on May 7, 2018, which is a continuation of application No.
(Continued)

(51) Int. Cl.
*H01F 7/02* (2006.01)
*A45C 13/10* (2006.01)
(Continued)

(52) U.S. Cl.
CPC ..... *H01F 7/0215* (2013.01); *A45C 13/1069* (2013.01); *H01F 7/0263* (2013.01);
(Continued)

(58) Field of Classification Search
CPC ..... H01F 1/00; H01F 7/0215; H01F 7/0263
See application file for complete search history.

(56) References Cited

U.S. PATENT DOCUMENTS 2,319,292 A * 5/1943 Boggs ..... A41D 3/08 2/96
2,627,097 A 2/1953 Robert
(Continued)

FOREIGN PATENT DOCUMENTS

EP 0958750 11/1999
EP 1864916 12/2007
(Continued)

OTHER PUBLICATIONS

Communication of Opposition dated Dec. 12, 2019 from the European Patent Office for Application No. EP11783162.8, including the statement of Opposition dated Nov. 27, 2019.
(Continued)

*Primary Examiner* — Jason W San
(74) *Attorney, Agent, or Firm* — Akerman LLP

(57) ABSTRACT

A magnetic sealing closure, comprising: a. a first flexible strip, with a plurality of cavities adapted to incorporate a plurality of magnetic elements; b. a second flexible strip, with a plurality of cavities adapted to incorporate a plurality of magnetic elements; wherein said sealing closure comprises membranes connectable to said first strip, and a second membrane connectable to said second strip, such that said plurality of magnetic elements of said second strip are embedded within said plurality of cavities between said second strip and said second membrane; when said first and second strips and are brought together from the side of said first and second membranes, magnetic elements of said first and said second strips magnetically attract each other, such that a sealing is provided.

19 Claims, 8 Drawing Sheets

Related U.S. Application Data

13/698,320, filed as application No. PCT/IL2011/000381 on May 12, 2011, now Pat. No. 9,966,174.

(60) Provisional application No. 61/345,120, filed on May 16, 2010, provisional application No. 61/413,996, filed on Nov. 16, 2010.

(51) Int. Cl.
*A41F 1/00* (2006.01)
*E04H 15/32* (2006.01)

(52) U.S. Cl.
CPC ..... *A41F 1/002* (2013.01); *E04H 15/32* (2013.01); *Y10T 24/32* (2015.01)

(56) References Cited

U.S. PATENT DOCUMENTS 2,959,832 A * 11/1960 Baermann ..... A45C 13/1069 24/303
3,102,314 A * 9/1963 Alderfer ..... A41F 1/002 24/303
3,161,932 A * 12/1964 Russell ..... A41F 1/002 24/303
3,176,364 A 4/1965 Dritz
3,211,966 A * 10/1965 Blume ..... H01F 1/04 335/302
3,324,521 A * 6/1967 Humiston ..... A41F 1/002 24/303
3,464,094 A 9/1969 Mates
3,483,494 A * 12/1969 Cromie ..... A61B 46/23 128/852
3,546,643 A * 12/1970 Virostek ..... A61B 50/20 335/303
3,629,905 A * 12/1971 Cote ..... B65D 33/1675 24/30.5 R
3,665,355 A * 5/1972 Sasaki ..... H01F 7/0215 335/306
3,710,291 A * 1/1973 Nicoud ..... H01F 7/0215 335/306
3,727,658 A * 4/1973 Eldridge, Jr. ..... A61B 50/362 206/370
3,827,019 A * 7/1974 Serbu ..... A41F 1/002 335/285
3,838,482 A 10/1974 Wallace
3,919,743 A 11/1975 Cutler
4,006,562 A 2/1977 Belanger
4,021,891 A * 5/1977 Morita ..... A45C 13/1069 24/303
4,058,335 A 11/1977 Abe
4,236,331 A 12/1980 Mattson
4,374,888 A * 2/1983 Bornslaeger ..... B32B 5/26 428/198
4,399,595 A * 8/1983 Yoon ..... A41F 1/002 24/303
4,426,816 A 1/1984 Dean
4,451,321 A 5/1984 McKelvey
4,542,545 A 9/1985 Johnson
4,702,038 A 10/1987 Frey
4,826,059 A * 5/1989 Bosch ..... A45C 11/24 206/350
5,081,748 A 1/1992 Eberle
5,186,373 A * 2/1993 Taylor ..... A45F 5/02 224/183
5,598,049 A 1/1997 Meier
5,604,960 A * 2/1997 Good ..... A41F 1/002 24/303
5,634,391 A 6/1997 Eady
5,682,653 A * 11/1997 Berglof ..... G09F 1/10 24/303
5,901,625 A 5/1999 May
6,101,688 A 8/2000 Marchesi
6,226,842 B1 * 5/2001 Wong ..... A41F 1/002 24/303
6,301,754 B1 * 10/2001 Grunberger ..... A41F 1/002 24/303
6,412,116 B1 * 7/2002 Clark ..... A41F 1/002 2/129
6,434,801 B2 * 8/2002 Grunberger ..... A41F 1/002 24/114.6
6,694,575 B1 2/2004 Martin
6,854,886 B2 2/2005 Plechocki
6,926,469 B2 8/2005 Janesky
7,022,394 B2 * 4/2006 Fujisawa ..... A44B 18/0049 428/99
7,154,363 B2 12/2006 Hunts
7,171,730 B2 2/2007 Kasai
7,187,261 B2 * 3/2007 Cassar ..... B23Q 3/1546 335/303
8,662,298 B2 * 3/2014 Aldana ..... A45C 11/00 206/320
8,695,193 B2 * 4/2014 Kress ..... A47H 99/00 112/475.06
8,915,208 B2 * 12/2014 Shanahan ..... G09F 17/00 116/173
9,549,580 B2 * 1/2017 Horton ..... A41F 1/002
9,966,174 B2 * 5/2018 Naftali ..... H01F 7/0215
2001/0014998 A1 8/2001 Grunberger
2001/0055666 A1 * 12/2001 Lee ..... H01F 1/117 428/156
2003/0029006 A1 * 2/2003 Pelt ..... A45F 5/022 24/303
2003/0230606 A1 * 12/2003 Devinie ..... A45F 5/00 224/183
2004/0237266 A1 12/2004 Wang
2005/0102802 A1 * 5/2005 Sitbon ..... A41F 1/002 24/303
2006/0006969 A1 * 1/2006 Cassar ..... B23Q 3/1546 335/306
2006/0056743 A1 3/2006 Kobetsky
2006/0172103 A1 * 8/2006 Chang ..... H01F 7/0215 428/40.1
2006/0252284 A1 11/2006 Marmaropoulos et al.
2007/0051785 A1 3/2007 Roessiger
2007/0094852 A1 * 5/2007 Wang ..... A44B 19/32 24/389
2007/0214613 A1 * 9/2007 Shiao ..... A63B 55/00 24/303
2007/0218234 A1 * 9/2007 Wu ..... G09F 7/04 428/40.1
2007/0218235 A1 * 9/2007 Wu ..... H01F 7/0215 428/40.1
2009/0100648 A1 4/2009 Naftalin
2009/0100651 A1 4/2009 Naftalin
2009/0178245 A1 * 7/2009 Albert ..... A41F 1/002 24/303
2009/0211533 A1 8/2009 Sprung
2009/0288241 A1 * 11/2009 Fullerton ..... A41D 13/1161 2/421
2009/0289090 A1 * 11/2009 Fullerton ..... A45F 5/02 224/183
2010/0125982 A1 * 5/2010 Chou ..... A44B 19/32 24/397
2010/0275419 A1 * 11/2010 Millus ..... A47G 21/167 24/306
2011/0131742 A1 * 6/2011 Cheung ..... A47L 23/10 15/210.1
2011/0303254 A1 * 12/2011 Tucker ..... E04B 1/167 135/96
2012/0216374 A1 * 8/2012 Manuello ..... A41F 1/002 24/303
2015/0196955 A1 7/2015 Naftalin

FOREIGN PATENT DOCUMENTS

JP S49112604 9/1974
JP H02118651 9/1990
JP H04-74010 11/1990

(56) References Cited

FOREIGN PATENT DOCUMENTS

| | | |
|---|---|---|
| JP | H0426864 | 3/1992 |
| JP | H08502427 | 3/1996 |
| JP | H09328149 | 12/1997 |
| JP | H11269713 | 10/1999 |
| JP | 2005335769 | 12/2005 |
| WO | 1994/008541 | 4/1994 |
| WO | 1995019754 | 7/1995 |
| WO | 2008025905 | 3/2008 |
| WO | 2009052458 | 4/2009 |
| WO | 2009053458 | 4/2009 |
| WO | 2011145088 | 11/2011 |

OTHER PUBLICATIONS

Document from WayBackMachine Jun. 26, 2010 gooperhermetic.com, retrieved from the Statement of Opposition.
https://www.youtube.com/watch?v=MqcCQK7yaj0 "Gooper waterproof pouch", cited in the Statement of Opposition.
https://www.youtube.com/watch?v=JKhMGTzQ5f4 "Gooper ready to go 2", cited in the Statement of Opposition.
https://www.youtube.com/watch?v=5d2wwq6NPPY "Gooper Ready to go 1", cited in the Statement of Opposition.
https://www.youtube.com/watch?v=vZe8si4nrnw "Diving with Gooper 4", cited in the Statement of Opposition.
https://www.youtube.com/watch?v=22u2WajMO5Q "Diving with Gooper 3", cited in the Statement of Opposition.
https://www.youtube.com/watch?v=1-7swSbqjrE (Video Unavailable), cited in the Statement of Opposition.
https://www.youtube.com/watch?v=qiAfr1oVpXk "Gooper water-[roof demonstration", cited in the Statement of Opposition.
International Search Report of PCT/IL2011/000381 dated Dec. 5, 2011.
Written Opinion of the International Search Authority of PCT/IL2011/000381 dated Dec. 5, 2011.
International Preliminary Report on Patentability of PCT/IL2011/000381 dated Jun. 5, 2012.
Patent Examination Report of the Australian Patent Office dated Sep. 16, 2014, in the corresponding Australian Patent Application No. 2011254211.
Office Action of the Israeli Patent Office dated May 19, 2013, in the corresponding Israeli Patent Application No. 205846. (Copy was provided with filing of Information Disclosure Statement for parent U.S. Appl. No. 13/698,320).
Office Action of the Israeli Patent Office dated May 3, 2015, in the corresponding Israeli Patent Application No. 205846. (Copy was provided with filing of Information Disclosure Statement for parent U.S. Appl. No. 13/698,320).
Office Action of the Israeli Patent Office dated Mar. 2, 2015, in the corresponding Israeli Patent Application No. 205846. (Copy was provided with filing of Information Disclosure Statement for parent U.S. Appl. No. 13/698,320).
Notification of Reason for Refusal of the Japanese Patent Office dated Mar. 10, 2015 in the corresponding Japanese Patent Application No. 2013-510725.
Decision of Refusal of the Japanese Patent Office dated Apr. 5, 2016 in the corresponding Japanese Patent Application No. 2013-510725.

* cited by examiner

FLEXIBLE MAGNETIC SEALING APPARATUS

CROSS REFERENCE TO RELATED APPLICATIONS

This application is a divisional application of U.S. patent application Ser. No. 15/972,981, filed May 7, 2018, which is a continuation of U.S. patent application Ser. No. 13/698,320, filed Nov. 16, 2012, now U.S. Pat. No. 9,966,174, which is a 371 application of International Application No. PCT/IL2011/000381, filed May 12, 2011, which claims the priority benefit of U.S. Provisional Application No. 61/345,120, filed May 16, 2010, and U.S. Provisional Application No. 61/413,996, filed Nov. 16, 2010, all of which are incorporated herein by reference.

FIELD OF THE INVENTION

The present invention generally relates to a sealing closure, and more specifically, to a sealing closure which is flexible and stable to mechanical deformations.

BACKGROUND OF THE INVENTION

The present invention discloses a sealing closure which can be used in various applications (e.g., textile). Magnetic strips are well known in the art, but these strips cannot be used for sealing because their magnetic strength is very low. Therefore, there is a need to use strong magnetic elements (e.g., Neodymium), which are embedded with flexible strips.

U.S. Pat. No. 7,187,261 (referred hereinafter to '261) discloses a magnetic strip that comprises a series of magnets, a flexible material strip locating and at least in part enclosing each surface of each magnet to define a longitudinal flexible arrangement capable of coupling to itself, a magnetisable material or to another magnet.

There are different problems with the flexible magnetic strip of patent '261. For example, this strip cannot be used to provide a sealing which is stable to various mechanical deformations (e.g., bending, twisting). One reason for this is the non-proximate distance between the magnetic elements of two strips which magnetically attract each other. Another reason for this is the mechanical characteristics of the materials from which the strips are made.

Therefore, it is a long felt need to provide a flexible sealing closure and/or sealable device which is made of at least one magnetic strips which is able to attract to another magnetic or ferromagnetic material, such that the magnetic attraction force of the magnets within the strip is not reduced.

SUMMARY OF THE INVENTION

It is one object of the present invention to disclose a sealing closure. The sealing closure comprises:

a. a first flexible strip, having a main axis, a first side and a second side, with a plurality of cavities adapted to incorporate a plurality of magnetic elements;

b. a second flexible strip, having a main axis, a first side and a second side, with a plurality of cavities adapted to incorporate a plurality of magnetic elements;

It is within the scope of the present invention that the sealing closure further comprises a first membrane connectable to the first side of the first strip, such that the plurality of magnetic elements of the first strip are embedded within the plurality of cavities between the first strip and the first membrane; and, the sealing closure further comprises a second membrane connectable to the first side of the second strip, such that the plurality of magnetic elements of the second strip are embedded within the plurality of cavities between the second strip and the second membrane; when the first and second strips and are brought together from the side of the first and second membranes, magnetic elements of the first and the second strips magnetically attract each other, such that a sealing is provided.

It is another object of the present invention to disclose the sealing closure as defined above, wherein each of the first and the second membranes is characterized by: (i) a predetermined thickness which substantially preserves the magnetic attraction capabilities of the plurality of magnetic elements of the first and second strips; and, (ii) a predetermined static friction coefficient which substantially prevents movement of the first membrane with respect to the second membrane; when provided, the sealing being stable to mechanical deformations of the sealing closure relative to the main axis of the first and second strips due to the predetermined thickness and the predetermined static friction coefficients of the first and second membranes.

It is another object of the present invention to disclose the sealing closure as defined above, wherein the first membrane and the second membrane are a first wall and a second wall of a sealable device.

It is another object of the present invention to disclose the sealing closure as defined above, wherein the predetermined thickness of each of the first and second membranes is between about 0.05 mm to about 0.6 mm.

It is another object of the present invention to disclose the sealing closure as defined above, wherein the predetermined thickness of each of the first and second membranes is about 0.2 mm.

It is another object of the present invention to disclose the sealing closure as defined above, wherein the predetermined static friction coefficient is between about 0.01 to about 0.99.

It is another object of the present invention to disclose the sealing closure as defined above, wherein the predetermined static friction coefficient is between about 0.1 to about 0.6.

It is another object of the present invention to disclose the sealing closure as defined above, wherein the predetermined static friction coefficient is about 0.5.

It is another object of the present invention to disclose the sealing closure as defined above, wherein the plurality of cavities are equally spaced between each other at a distance of between about 2 mm to about 8 mm, such that each magnetic element within each cavity of the plurality of cavities is characterized by: a diameter of between about 4 mm to about 10 mm; and, a thickness of between about 1 to about 3 mm.

It is another object of the present invention to disclose the sealing closure as defined above, wherein the first strip and the second strip are characterized by a width of between about 10 mm to about 20 mm, and a thickness of about 1 to about 3 mm.

It is another object of the present invention to disclose the sealing closure as defined above, wherein the first and second membranes and the first and second strips are made of polymeric materials selected from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly (trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof.

It is another object of the present invention to disclose the sealing closure as defined above, wherein the magnetic elements are made of a material selected from the group consisting of: Neodymium, Neodymium Iron Boron (NdFeB), Samarium-Cobalt, Electromagnet, any other type of rare-earth magnet, and any combination thereof.

It is another object of the present invention to disclose the sealing closure as defined above, wherein the mechanical deformations are selected from the group consisting of: bending, rotation, twisting, tilting, or any combination thereof.

It is another object of the present invention to disclose the sealing closure as defined above, wherein the sealing closure is flexible and water impermeable.

It is another object of the present invention to disclose the sealing closure as defined above, wherein the sealing closure is adapted to be incorporated within a sealable device, such that when a sealing is provided by the sealing closure, the sealable device is sealed.

It is another object of the present invention to disclose the sealing closure as defined above, wherein the first strip is mechanically connectable to one portion of the sealable device via a first connecting means, and the second strip is mechanically connectable to another portion of the sealable device via a second connecting means.

It is another object of the present invention to disclose the sealing closure as defined above, wherein the one portion and the another portion of the strip are located at an opening of the sealable device.

It is another object of the present invention to disclose the sealing closure as defined above, wherein the first and the second connecting means are selected from the group consisting of: RF welding, ultrasonic welding, heat welding, sewing, via a seal tape, gluing, or any combination thereof.

It is another object of the present invention to disclose the sealing closure as defined above, wherein at least one of the first membrane or the second membrane is one of the one portion or the another portion.

It is another object of the present invention to disclose the sealing closure as defined above, wherein the sealable device is selected from the group consisting of: a pouch, a bag, a sack, a pocket, a device useful for sterile purposes, a door with a frame, a tent, a greenhouse, a waterproof pocket, or any combination thereof.

It is another object of the present invention to disclose the sealing closure as defined above, wherein the sealing closure is usable in fields selected from the group consisting of: packaging, storage, military, medical, agriculture, food, outdoor activities, textile, fashion, or any combination thereof.

It is another object of the present invention to disclose the sealing closure as defined above, wherein the sealing closure is a one way valve.

It is another object of the present invention to disclose the sealing closure as defined above, wherein the plurality of cavities of the first strip and the second strip are selected from the group consisting of: niches, recesses, pits, openings, holes, full openings, apertures, or any combination thereof.

It is another object of the present invention to disclose the sealing closure as defined above, wherein the sealing closure is manufactured according to a method selected from the group consisting of: extrusion, coextrusion, molding, or any combination thereof.

It is another object of the present invention to disclose the sealing closure as defined above, wherein the extrusion method is adapted to: (i) provide continuous first and second strip; and, (ii) form a plurality of cavities within the first and second strips.

It is another object of the present invention to disclose the sealing closure as defined above, wherein the molding method is adapted to provide the first strip and the second strip with the plurality of cavities according to a predetermined model.

It is another object of the present invention to disclose the sealing closure as defined above, wherein the sealing closure further comprises a coating adapted to be mechanically connected to at least one of the first strip and the second strip from the second side of the same, when the plurality of cavities are full openings.

It is another object of the present invention to disclose a method of manufacturing of a magnetic sealing closure. The method comprises steps of:

a. providing (i) a first flexible strip, having a main axis, a first side and a second side, with a plurality of cavities adapted to incorporate a plurality of magnetic elements; and, (ii) a second flexible strip, having a main axis, a first side and a second side, with a plurality of cavities adapted to incorporate a plurality of magnetic elements;
b. inserting the plurality of magnetic elements within the plurality of cavities of the first and the second strips;
c. connecting a first membrane to the first side of the first strip, thereby embedding the plurality of magnetic elements of the first strip within the plurality of cavities between the first strip and the first membrane;
d. connecting a second membrane to the first side of the second strip, thereby embedding the plurality of magnetic elements of the second strip within the plurality of cavities between the second strip and the second membrane; each of the first and the second membranes being characterized by: (i) a predetermined thickness which substantially preserves the magnetic attraction capabilities of the plurality of magnetic elements of the first and second strips; and, (ii) a predetermined static friction coefficient;
e. bringing together the first strip and the second strip from the side of the first and second membranes, and magnetically attracting the magnetic elements of the first strip and the second strip to each other, thereby providing a sealing;

it is within the scope of the present invention that the sealing is stable to mechanical deformations of the sealing closure relative to the main axis of the first and second strips, due to the predetermined thickness and the predetermined static friction coefficients of the first and second membranes.

It is another object of the present invention to disclose the method as defined above, wherein the step (a) of providing the first and the second strips, further comprises a step of manufacturing the first strip and the second strip according to a method selected from the group consisting of: extrusion, coextrusion, molding, or any combination thereof.

It is another object of the present invention to disclose the method as defined above, wherein the step of manufacturing the first strip and the second strip according to an extrusion method, further comprises steps of: (i) producing a continuous first and second strips; and, (ii) forming the plurality of cavities within the first strip and the second strip.

It is another object of the present invention to disclose the method as defined above, wherein the step of manufacturing the first strip and the second strip according to a molding method, further comprises steps of producing a strip with the plurality of cavities according to a predetermine model.

It is another object of the present invention to disclose the method as defined above, further comprising step of providing the first membrane and the second membrane with the predetermined thickness of between about 0.05 mm to about 0.6 mm.

It is another object of the present invention to disclose the method as defined above, further comprising step of providing the first membrane and the second membrane with the predetermined thickness of about 0.2 mm.

It is another object of the present invention to disclose the method as defined above, wherein the predetermined static friction coefficient is between about 0.01 to about 0.99.

It is another object of the present invention to disclose the method as defined above, wherein the predetermined static friction coefficient is between about 0.1 to about 0.6.

It is another object of the present invention to disclose the method as defined above, wherein the predetermined static friction coefficient is about 0.5.

It is another object of the present invention to disclose the method as defined above, wherein the step (a) of providing the first strip and the second strip with the plurality of cavities is performed such that the plurality of cavities are equally spaced between each other at a distance of between about 2 mm to about 8 mm, such that each magnetic element within each cavity of the plurality of cavities is characterized by: a diameter of between about 4 mm to about 10 mm; and, a thickness of between about 1 to about 3 mm.

It is another object of the present invention to disclose the method as defined above, further comprising step of providing the first strip and the second strip with the predetermined width of between about 10 mm to about 20 mm, and a thickness of about 1 to about 3 mm.

It is another object of the present invention to disclose the method as defined above, further comprising step of selecting the polymeric material of the first and second membranes and the first and second strips from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly(trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof.

It is another object of the present invention to disclose the method as defined above, further comprising step of providing the magnetic elements being made of a material selected from the group consisting of: Neodymium, Neodymium Iron Boron (NdFeB), Samarium-Cobalt, Electromagnet, any other type of rare-earth magnet, and any combination thereof.

It is another object of the present invention to disclose the method as defined above, further comprising step of selecting the mechanical deformation from the group consisting of: bending, rotation, twisting, tilting, or any combination thereof.

It is another object of the present invention to disclose the method as defined above, wherein the sealing closure is flexible and water impermeable.

It is another object of the present invention to disclose the method as defined above, further comprising step of incorporating the sealing closure within a sealable device, thereby sealing the sealing device when the sealing of step (e) is provided.

It is another object of the present invention to disclose the method as defined above, further comprising step of mechanically connecting the first strip to one portion of the sealable device via a first connecting means, and the second strip to another portion of the sealable device via a second connecting means.

It is another object of the present invention to disclose the method as defined above, wherein the one portion and the another portion of the strip are located at an opening of the sealable device.

It is another object of the present invention to disclose the method as defined above, wherein the first and the second connecting means are selected from the group consisting of: RF welding, ultrasonic welding, heat welding, sewing, via a seal tape, gluing, or any combination thereof.

It is another object of the present invention to disclose the method as defined above, wherein at least one of the first membrane or the second membrane is one of the one portion or the another portion.

It is another object of the present invention to disclose the method as defined above, further comprising step of selecting the sealable device from the group consisting of: a pouch, a bag, a sack, a pocket, a device useful for sterile purposes, a door with a frame, a tent, a greenhouse, a waterproof pocket, or any combination thereof.

It is another object of the present invention to disclose the method as defined above, wherein the sealing closure is usable in fields selected from the group consisting of: packaging, storage, military, medical, agriculture, food, outdoor activities, textile, fashion, or any combination thereof.

It is another object of the present invention to disclose the method as defined above, wherein the sealing closure is a one way valve.

It is another object of the present invention to disclose the method as defined above, wherein the plurality of cavities of the first strip and the second strip are selected from the group consisting of: niches, recesses, pits, openings, holes, full openings, apertures, or any combination thereof.

It is another object of the present invention to disclose the method as defined above, further comprising step of mechanically connecting a coating to at least one of the first strip and the second strip from the second side of the same, when the plurality of cavities are full openings.

It is another object of the present invention to disclose a magnetic strip. The magnetic strip comprises a first flexible strip, having a main axis, a first side and a second side, with a plurality of cavities adapted to incorporate a plurality of magnetic elements; wherein the magnetic strip further comprises a first membrane connectable to the first side of the first strip, such that the plurality of magnetic elements of the first strip are embedded within the plurality of cavities between the first strip and the first membrane;

It is another object of the present invention to disclose the magnetic strip as defined above, wherein the magnetic strip is adapted to attract to a ferromagnetic material or a magnetic material from the side of the first membrane.

It is another object of the present invention to disclose the magnetic strip as defined above, wherein the magnetic strip is adapted to attract to a curved surface while preserving the connection of the same along the length of the same.

It is another object of the present invention to disclose the magnetic strip as defined above, wherein the first membrane and is characterized by: (i) a predetermined thickness which substantially preserves the magnetic attraction capabilities of the plurality of magnetic elements of the first strip; and, (ii) a predetermined static friction coefficient which substantially prevents movement of the first membrane with respect to a material to which the magnetic elements are attracted It is another object of the present invention to disclose the magnetic strip as defined above, wherein the predetermined thickness of the first membrane is between about 0.05 mm to about 0.6 mm.

It is another object of the present invention to disclose the magnetic strip as defined above, wherein the predetermined thickness of the first membrane is about 0.2 mm.

It is another object of the present invention to disclose the sealing closure as defined above, wherein the predetermined static friction coefficient is between about 0.01 to about 0.99.

It is another object of the present invention to disclose the magnetic strip as defined above, wherein the predetermined static friction coefficient is between about 0.1 to about 0.6.

It is another object of the present invention to disclose the magnetic strip as defined above, wherein the predetermined static friction coefficient is about 0.5.

It is another object of the present invention to disclose the magnetic strip as defined above, wherein the plurality of cavities are equally spaced between each other at a distance of between about 2 mm to about 8 mm, such that each magnetic element within each cavity of the plurality of cavities is characterized by: a diameter of between about 4 mm to about 10 mm; and, a thickness of between about 1 to about 3 mm.

It is another object of the present invention to disclose the magnetic strip as defined above, wherein the first strip and the second strip are characterized by a width of between about 10 mm to about 20 mm, and a thickness of about 1 to about 3 mm.

It is another object of the present invention to disclose the magnetic strip as defined above, wherein the first membrane and the first strip are made of polymeric materials selected from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly(butylene terephthalate) (PBT), poly (ether sulfone) (PES, PES/PEES), poly(ether ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly(trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof.

It is another object of the present invention to disclose the magnetic strip as defined above, wherein the magnetic elements are made of a material selected from the group consisting of: Neodymium, Neodymium Iron Boron (NdFeB), Samarium-Cobalt, Electromagnet, any other type of rare-earth magnet, and any combination thereof.

It is another object of the present invention to disclose the magnetic strip as defined above, wherein the magnetic strip is stable to mechanical deformations selected from the group consisting of: bending, rotation, twisting, tilting, or any combination thereof.

It is another object of the present invention to disclose the magnetic strip as defined above, wherein the magnetic strip is flexible and water impermeable.

It is another object of the present invention to disclose the magnetic strip as defined above, wherein the magnetic strip is adapted to be incorporated within a sealable device, such that when the magnetic strip is attracted to another ferromagnetic or magnetic element, the sealable device is sealed.

It is another object of the present invention to disclose the magnetic strip as defined above, wherein the first strip is mechanically connectable to one portion of the sealable device via a first connecting means.

It is another object of the present invention to disclose the magnetic strip as defined above, wherein the one portion is located at an opening of the sealable device.

It is another object of the present invention to disclose the magnetic strip as defined above, wherein the first connecting means is selected from the group consisting of: RF welding, ultrasonic welding, heat welding, sewing, via a seal tape, gluing, or any combination thereof.

It is another object of the present invention to disclose the magnetic strip as defined above, wherein the one portion is the first membrane.

It is another object of the present invention to disclose the magnetic strip as defined above, wherein the sealable device is selected from the group consisting of: a pouch, a bag, a sack, a pocket, a device useful for sterile purposes, a door with a frame, a tent, a greenhouse, a waterproof pocket, or any combination thereof.

It is another object of the present invention to disclose the magnetic strip as defined above, wherein the sealing closure is usable in fields selected from the group consisting of: packaging, storage, military, medical, agriculture, food, outdoor activities, textile, fashion, or any combination thereof.

It is another object of the present invention to disclose the magnetic strip as defined above, wherein the sealing closure is a one way valve.

It is another object of the present invention to disclose the magnetic strip as defined above, wherein the plurality of cavities of the first strip are selected from the group consisting of: niches, recesses, pits, openings, holes, full openings, apertures, or any combination thereof.

It is another object of the present invention to disclose the magnetic strip as defined above, further comprising a second membrane connectable to the second side of the first strip, such that the plurality of magnetic elements of the first strip are embedded within the plurality of cavities between the first strip and the second membrane.

It is another object of the present invention to disclose the magnetic strip as defined above, wherein the sealing closure is manufactured according to a method selected from the group consisting of: extrusion, coextrusion, molding, or any combination thereof.

It is another object of the present invention to disclose the magnetic strip as defined above, wherein the extrusion method is adapted to: (i) provide continuous first strip; and, (ii) form a plurality of cavities within the first strip.

It is another object of the present invention to disclose the magnetic strip as defined above, wherein the molding method is adapted to provide the first strip with the plurality of cavities according to a predetermined model.

It is another object of the present invention to disclose the magnetic strip as defined above, wherein the magnetic strip further comprises a coating adapted to be mechanically connected to the first strip from the second side of the same, when the plurality of cavities are full openings.

It is another object of the present invention to disclose a sealable device. The sealable device comprises:

a. a first flexible strip, having a main axis, a first side and a second side, with a plurality of cavities adapted to incorporate a plurality of magnetic elements;

b. a second flexible strip, having a main axis, a first side and a second side, with a plurality of cavities adapted to incorporate a plurality of magnetic elements;

c. a first wall connectable to the first side of the first strip, such that the plurality of magnetic elements of the first strip are embedded within the plurality of cavities between the first strip and the first wall;

d. a second wall connectable to the first side of the second strip, such that the plurality of magnetic elements of the second strip are embedded within the plurality of cavities between the second strip and the second wall;

It is within the scope of the present invention that the first and second strips and are adapted to be brought together from the side of the first and second walls, such that the magnetic elements of the first and the second strips magnetically attract each other and a sealing is provided.

It is another object of the present invention to disclose the sealable device as defined above, wherein each of the first and the second walls is characterized by: (i) a predetermined thickness which substantially preserves the magnetic attraction capabilities of the plurality of magnetic elements of the first and second strips; and, (ii) a predetermined static friction coefficient which substantially prevents movement of the first wall with respect to the second wall; when provided, the sealing being stable to mechanical deformations of the sealing device relative to the main axis of the first and second strips due to the predetermined thickness and the predetermined static friction coefficients of the first and second walls.

It is another object of the present invention to disclose the sealable device as defined above, wherein the predetermined thickness of each of the first and second walls is between about 0.05 mm to about 0.6 mm.

It is another object of the present invention to disclose the sealable device as defined above, wherein the predetermined thickness of each of the first and second walls is about 0.2 mm.

It is another object of the present invention to disclose the sealable device as defined above, wherein the predetermined static friction coefficient is between about 0.01 to about 0.99.

It is another object of the present invention to disclose the sealable device as defined above, wherein the predetermined static friction coefficient is between about 0.1 to about 0.6.

It is another object of the present invention to disclose the sealable device as defined above, wherein the predetermined static friction coefficient is about 0.5.

It is another object of the present invention to disclose the sealable device as defined above, wherein the plurality of cavities are equally spaced between each other at a distance of between about 2 mm to about 8 mm, such that each magnetic element within each cavity of the plurality of cavities is characterized by: a diameter of between about 4 mm to about 10 mm; and, a thickness of between about 1 to about 3 mm.

It is another object of the present invention to disclose the sealable device as defined above, wherein the first strip and the second strip are characterized by a width of between about 10 mm to about 20 mm, and a thickness of about 1 to about 3 mm.

It is another object of the present invention to disclose the sealable device as defined above, wherein the first and second walls and the first and second strips are made of polymeric materials selected from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly (trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof.

It is another object of the present invention to disclose the sealable device as defined above, wherein the magnetic elements are made of a material selected from the group consisting of: Neodymium, Neodymium Iron Boron (NdFeB), Samarium-Cobalt, Electromagnet, any other type of rare-earth magnet, and any combination thereof.

It is another object of the present invention to disclose the sealable device as defined above, wherein the mechanical deformations are selected from the group consisting of: bending, rotation, twisting, tilting, or any combination thereof.

It is another object of the present invention to disclose the sealable device as defined above, wherein the sealing closure is flexible and water impermeable.

It is another object of the present invention to disclose the sealable device as defined above, wherein the first strip and the second strip are locatable at an opening of the sealable device.

It is another object of the present invention to disclose the sealable device as defined above, wherein the first and the second strips are connectable to the first and the second walls via a connecting means selected from the group consisting of: RF welding, ultrasonic welding, heat welding, sewing, via a seal tape, gluing, or any combination thereof.

It is another object of the present invention to disclose the sealable device as defined above, wherein the sealable device is selected from the group consisting of: a pouch, a bag, a sack, a pocket, a device useful for sterile purposes, a door with a frame, a tent, a greenhouse, a waterproof pocket, or any combination thereof.

It is another object of the present invention to disclose the sealable device as defined above, wherein the sealing device is usable in fields selected from the group consisting of: packaging, storage, military, medical, agriculture, food, outdoor activities, textile, fashion, or any combination thereof.

It is another object of the present invention to disclose the sealable device as defined above, wherein the sealable device is a one way valve.

It is another object of the present invention to disclose the sealable device as defined above, wherein the plurality of cavities of the first strip and the second strip are selected from the group consisting of: niches, recesses, pits, openings, holes, full openings, apertures, or any combination thereof.

It is another object of the present invention to disclose the sealable device as defined above, wherein the sealing closure is manufactured according to a method selected from the group consisting of: extrusion, coextrusion, molding, or any combination thereof.

It is another object of the present invention to disclose the sealable device as defined above, wherein the extrusion method is adapted to: (i) provide continuous first and second strip; and, (ii) form a plurality of cavities within the first and second strips.

It is another object of the present invention to disclose the sealable device as defined above, wherein the molding method is adapted to provide the first strip and the second strip with the plurality of cavities according to a predetermined model.

It is another object of the present invention to disclose the sealable device as defined above, further comprising an additional membrane adapted to be mechanically connected to at least one of the first strip and the second strip from the second side of the same, when the plurality of cavities are full openings.

It is another object of the present invention to disclose the sealable device as defined above, further comprising a third magnetic element.

It is another object of the present invention to disclose the sealable device as defined above, wherein the third magnetic element comprising a third flexible strip, having a main axis, a first side and a second side, with a plurality of cavities adapted to incorporate a plurality of magnetic elements, the third strip is connectable to one of the first wall or the second wall, such that the plurality of magnetic elements of the third strip are embedded within the plurality of cavities between the third strip and one of the first wall or the second wall.

It is another object of the present invention to disclose the sealable device as defined above, wherein the sealing of the first and the second strips is adapted to be bent towards the direction of the third strip; further wherein the sealing of the first and the second strips is adapted to magnetically attract to the second side of the third strip, so as to improve the sealing.

It is another object of the present invention to disclose the sealable device as defined above, further comprising:

a third flexible strip, having a main axis, a first side and a second side, with a plurality of cavities adapted to incorporate a plurality of magnetic elements, the third strip is connectable to the first wall, such that the plurality of magnetic elements of the third strip are embedded within the plurality of cavities between the third strip and the first wall;

a fourth flexible strip, having a main axis, a first side and a second side, with a plurality of cavities adapted to incorporate a plurality of magnetic elements, the fourth strip is connectable to the second wall, such that the plurality of magnetic elements of the fourth strip are embedded within the plurality of cavities between the fourth strip and the second wall; the third and fourth strips and are adapted to be brought together from the side of the first and second walls, such that the magnetic elements of the third and the fourth strips magnetically attract each other and a sealing is provided.

It is another object of the present invention to disclose the sealable device as defined above, wherein the third strip is parallel to the first strip, and the second strip is parallel to the fourth strip.

It is another object of the present invention to disclose the sealable device as defined above, wherein the sealing of the first and the second strips is adapted to be bent towards the direction of one of the: the second side of the third strip or the second the of the fourth strip; further wherein the sealing of the first and the second strips is adapted to magnetically attract to one of the: the second side of the third strip or the second the of the fourth strip, so as to improve the sealing.

It is another object of the present invention to disclose a one way valve. The one way valve comprises:

a. a first flexible strip, having a main axis, a first side and a second side, with a plurality of cavities adapted to incorporate a plurality of magnetic elements;

b. a second flexible strip, having a main axis, a first side and a second side, with a plurality of cavities adapted to incorporate a plurality of magnetic elements;

It is within the scope of the present invention that the one way valve further comprises a first membrane connectable to the first side of the first strip, such that the plurality of magnetic elements of the first strip are embedded within the plurality of cavities between the first strip and the first membrane; and, the one way valve further comprises a second membrane connectable to the first side of the second strip, such that the plurality of magnetic elements of the second strip are embedded within the plurality of cavities between the second strip and the second membrane; when the first and second strips and are brought together from the side of the first and second membranes, magnetic elements of the first and the second strips magnetically attract each other, such that a sealing is provided;

It is within the scope of the present invention that each of the first and the second membranes is characterized by: (i) a predetermined thickness which substantially preserves the magnetic attraction capabilities of the plurality of magnetic elements of the first and second strips; and, (ii) a predetermined static friction coefficient which substantially prevents movement of the first membrane with respect to the second membrane; when provided, the sealing being stable to mechanical deformations of the one way valve relative to the main axis of the first and second strips, due to the predetermined thickness and the predetermined static friction coefficients of the first and second membranes.

It is another object of the present invention to disclose the one way valve as defined above, wherein the one way valve is adapted to be incorporated within an opening of a sealable device, such that when a predetermined pressure is actuated on the sealable device, the content of the sealable device departures the sealable device in a one way manner.

It is another object of the present invention to disclose a method of manufacturing a sealable device, said device comprising a magnetic sealing closure having a first flexible strip, having a main axis, a first side and a second side, with a plurality of cavities adapted to incorporate a plurality of magnetic elements;

a second flexible strip, having a main axis, a first side and a second side, with a plurality of cavities adapted to incorporate a plurality of magnetic elements;

a first wall connectable to said first side of said first strip, such that said plurality of magnetic elements of said first strip are embedded within said plurality of cavities between said first strip and said first wall;

a second wall connectable to said first side of said second strip, such that said plurality of magnetic elements of said second strip are embedded within said plurality of cavities between said second strip and said second wall;

wherein said first and second strips and are adapted to be brought together from the side of said first and second walls, such that said magnetic elements of said first and said second strips magnetically attract each other and a sealing is provided, the aforementioned method comprising steps of injecting in a single mould the body of the sealable device and the magnetic sealing closure and incorporating within said body said magnetic sealing closure during the mould casting process.

BRIEF DESCRIPTION OF THE FIGURES

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

Figure 1:
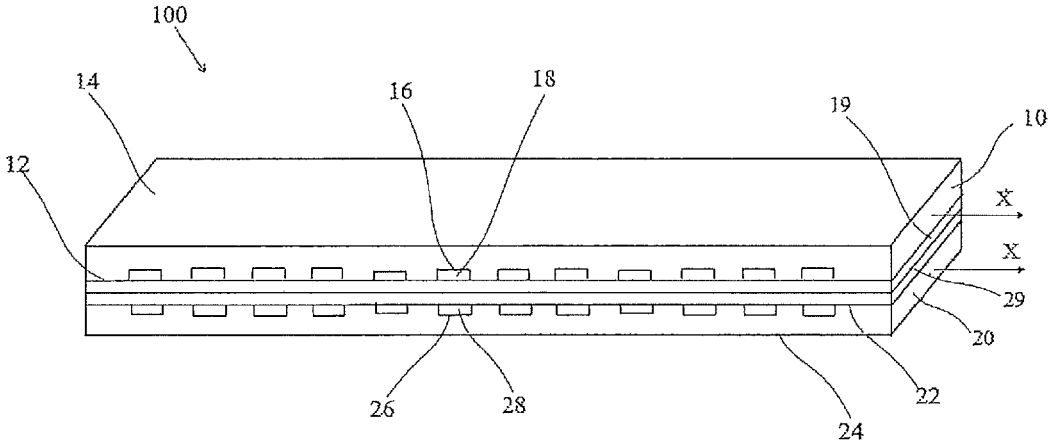
FIG. 1 is an illustration of specific embodiments of the sealing closure of the present invention.

The drawings together with the description make apparent to those skilled in the art how the invention may be embodied in practice.

DETAILED DESCRIPTION OF THE PREFERRED EMBODIMENTS

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The term 'sealing' refers hereinafter to a fastening procedure which provides a tight and/or hermetic closure, and/or to provide a closure which excludes passage of different materials (e.g., water, gas, air, etc.) through the sealing closure.

The term 'about' refers hereinafter to an accuracy of a predetermined measure within a certainty of ±25%.

The term 'ferromagnetic material' refers hereinafter to any material to which a magnetic material is able to be magnetically attracted. For example, the term 'ferromagnetic material' may refers to: iron, nickel, cobalt, some alloys of rare earth metals, and some naturally occurring minerals such as lodestone.

The term 'sealable device' refers hereinafter to any device which is able to be sealed by the sealing closure of the present invention. For example, the sealable device may be: a pouch, a bag, a sack, a pocket, a device useful for sterile purposes, a waterproof money belt, a waterproof pocket, a door with a frame, a tent, a greenhouse, a waterproof pocket, or any combination thereof.

The term 'strip' refers hereinafter to any substantially flexible object which may be characterized by any known in the art geometrical structure. According to the preferred embodiment, the geometrical structure is an elongated rectangular structure. According to other embodiments, the geometrical structure may be: square, oval, round, polygonal, etc.

The term 'full opening' refers hereinafter to any opening within a strip which may be approached from at least two different sides of a strip.

The term 'magnetic elements' refers hereinafter to any type of elements which may be made of a strong magnetic material such as: Neodymium (e.g., Neodymium Iron Boron (NdFeB)), Samarium-Cobalt or any other type of rare-earth magnet (or composition of materials). According to some embodiments, the 'magnetic element' may be an electromagnetic element which is well known in the art.

The term 'plurality' refers hereinafter to at least one object.

The present invention discloses a novel magnetic sealing closure 100 usable in various fields, as will be presented below.

According to FIG. 1, which schematically illustrates a specific embodiment of sealing closure 100, the sealing closure 100 comprises the following:

a. A first flexible strip 10, having a main axis X, a first side 12 and a second side 14, with a plurality of cavities 16 which are adapted to incorporate a plurality of magnetic elements 18.

b. A second flexible strip 20, having a main axis X, a first side 22 and a second side 24, with a plurality of cavities 26 which are adapted to incorporate a plurality of magnetic elements 28.

The main novel element according to which a mechanically stable sealing can be provided via sealing closure 100, is a first membrane 19 which is connectable to first side 12 of first strip 10, and a second membrane 29 which is connectable to first side 22 of second strip 20.

One of the main purposes of first membrane 19 is to encapsulate and embed magnetic elements 18 of first strip 10 within plurality of cavities 16, between first strip 10 and first membrane 19. One of the main purposes of second membrane 29 is to encapsulate and embed magnetic elements 28 of second strip 20 within plurality of cavities 26, between second strip 20 and second membrane 29.

According to different embodiments of the present invention, the magnetic sealing closure of the present invention may be used as a combination of two or more magnetic strips 10 and 20, which may be magnetically attracted and thus connectable to each other and also to other magnetic or ferromagnetic elements.

As illustrated in FIG. 1, first strip 10 and second strip 20 are brought together from the side of first membrane 19 and second membrane 29, such that they are in contact with each other, and such that magnetic elements 18 and 28 magnetically attract each other. This magnetic attraction is adapted to provide a sealing.

As will be discloses below, the special construction of each one of the strips 10 and 20 with magnetic elements and membranes, is adapted to provide a sealing which is stable to mechanical deformations. A stable sealing is a sealing in which strip 10 and strip 20 are not disconnected from each other when mechanical deformations of sealing closure 100 occur.

The inventors of the present invention have discovered that is order to provide a stable sealing, membranes 19 and 29 have to be thin enough, so that magnetic elements 18 and 28 will be close enough to each other when they attract each other.

One of the main characteristics of the present invention, according to which the stability of the sealing is available, is the relatively thin thickness of first membrane 19 and second membrane 29. First membrane 19 and second membrane 29 are characterized by a predetermined thickness which substantially preserves the magnetic attraction capabilities of plurality of magnetic elements 18 and 28 of first and second strips 10 and 20.

According to some embodiment of the present invention, the predetermined thickness of each of first and second membranes 19 and 29 is between about 0.05 mm to about 0.6 mm. Preferably, this thickness is between about 0.2 mm to about 0.4 mm.

The inventors of the present invention have additionally discovered that is order to provide a stable sealing, membranes 19 and 29 have to be characterized by a predetermined static friction coefficient. The predetermined static friction coefficient of membranes 19 and 29 is adapted to prevent relative movement of membranes 19 and 29 with respect to each other, when mechanical deformations of sealing closure 100 occur.

According to some embodiments of the present invention, the predetermined static friction coefficient is between about 0.01 to about 0.99. According to other embodiments of the present invention, the predetermined static friction coefficient is between about 0.1 to about 0.6. Preferable, the predetermined static friction coefficient is about 0.5.

The sealing which is provided by sealing closure 100 of the present invention, is adapted to be stable to various mechanical deformations relative to main axis X of first and second strips 10 and 20 when they are brought together. For example, these mechanical deformations may be: bending, rotation, twisting, tilting, or any combination thereof. The bending may be to a full circle, and the twisting may be in more than 360°. This stability is provided both by said predetermined thickness of membranes 19 and 29, and their predetermined friction coefficient.

It is important to emphasize that in order to provide stability of the sealing, according to some embodiment of the present invention, only one of the two main characteristics (the thickness and the friction coefficient) of the membranes is required.

In FIG. 1, a side view of the present invention is illustrated.

Figure 2:
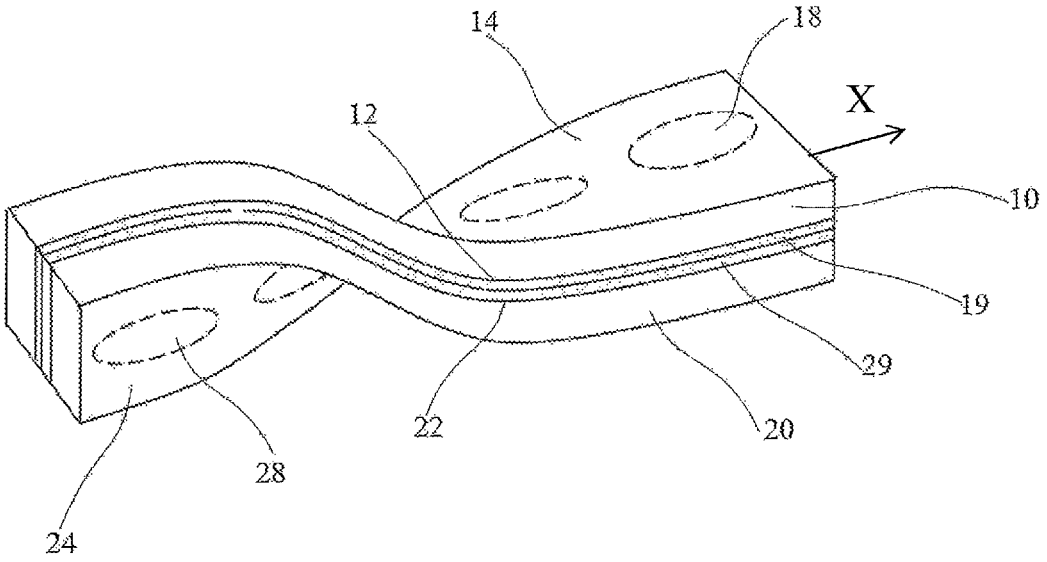
FIG. 2 is an illustration of mechanical deformations which are applied on the sealing closure of the present invention.

Reference is now made to FIG. 2 which schematically illustrates the advantages of the present invention over the prior art. More specifically, FIG. 2 illustrates stability of the sealing, when mechanical twist deformation around axis X is applied by user 90. The first and the second strips 10 and 20 remain coupled in the region of the twist 30.

According to FIG. 1, plurality of cavities 16 and 26 are equally spaced between each other at a distance of about 3 mm. According to other embodiments, this distance is between about 2 mm to about 8 mm. According to the embodiment in FIG. 1, magnetic elements 18 and 28 are characterized by: a diameter of about 6 mm, and a thickness of about 2 mm. According to other embodiments, the diameter is about between about 4 mm to about 10 mm, and the thickness is between about 1 to about 3 mm.

According to FIG. 1, first strip 10 and second strip 20 are characterized by a width of between about 10 mm to about 20 mm, and a thickness of about 1 to about 3 mm.

According to some embodiment, first and second membranes 19 and 29 and first and second strips 10 and 20 are made of polymeric materials selected from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly(trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof. It is also appreciated that any convenient material known in the art may be used for the aforementioned membranes.

According to the preferred embodiments of the present invention, first and second membranes 19 are made of PVC.

According to some embodiment, magnetic elements 18 and 28 are made of a material selected from the group consisting of: Neodymium, Neodymium Iron Boron (NdFeB), Samarium-Cobalt, Electromagnet, any other type of rare-earth magnet, and any combination thereof.

It is further appreciated that, in some embodiments of the present invention, a first or second strip may be provided with at least some elements made of ferromagnetic material.

According to some embodiment, said sealing closure is flexible and water impermeable.

According to other embodiment, said sealing closure is impermeable to other known materials (e.g., air, gas, dust, chemical, biological, etc.)

According to the embodiment of FIG. 1, the plurality of cavities 16 and 26 are non-full holes, full openings, but only partial cavities. According to other embodiments, the plurality of cavities 16 and 26 may be: niches, recesses, pits, openings, holes, full openings, apertures, or any combination thereof.

According to other embodiments, in which the plurality of cavities are full openings (e.g., holes), first and second strips are coated with a coating which is mechanically connectable to the second side of at least one of the first and the second strips.

According to different embodiment of the present invention, the sealing closure is usable in fields selected from the group consisting of: packaging, storage, military, medical, agriculture, food, outdoor activities, textile, fashion, or any combination thereof.

Figure 3:
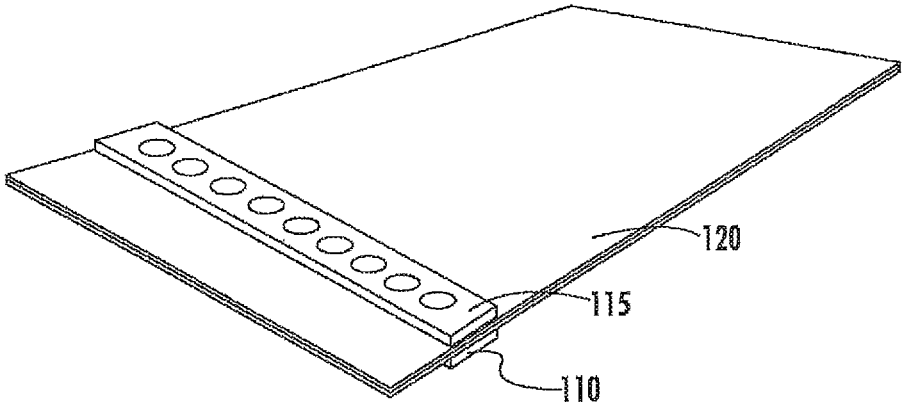
FIG. 3 is an illustration of one embodiment of the sealable device of the present invention.
Figure 4:
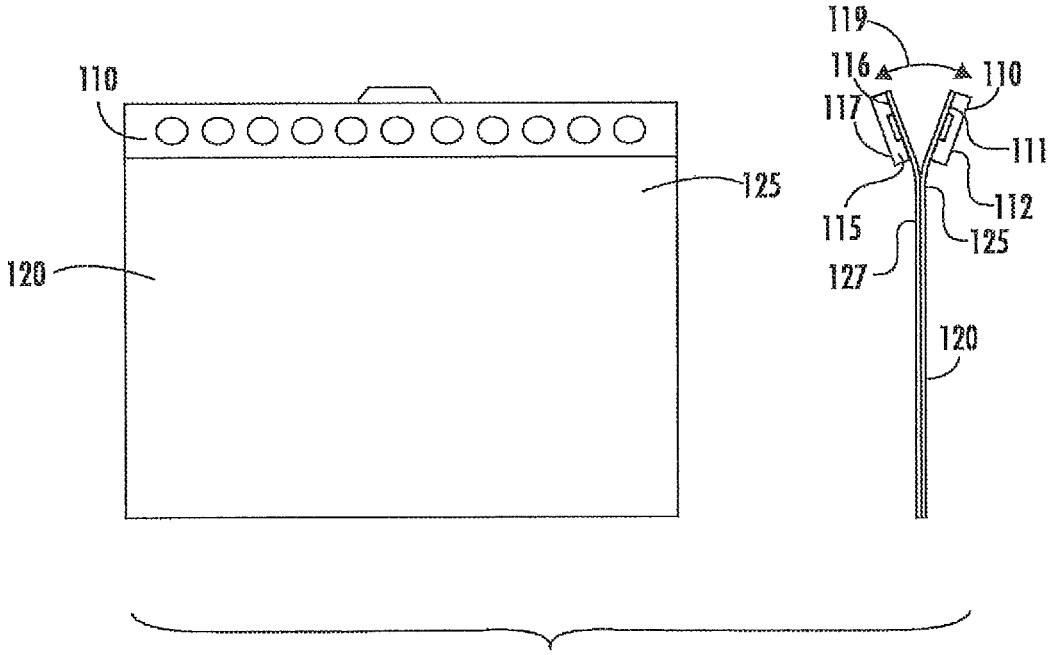
FIG. 4 is an illustration of another embodiment of the sealable device of the present invention.

Reference is now made to FIGS. 3-4 which schematically illustrate two magnetic strips of the present invention being incorporated in a sealable device 120. According to the embodiments of FIGS. 3-4, the membrane which is connectable to each one of the flexible strips is part of the sealable device. According to other embodiments, the membrane which is connectable to each one of the flexible strips is not part of the sealable device. According to these embodiments, the membrane is connectable via any conventional means to the walls of the sealable device.

According to the embodiment in which the membrane is part of the sealable device, the sealable device 120 of the present invention may comprise the following elements:

a. a first flexible strip 110, having a main axis, a first side 111 and a second side 112, with a plurality of cavities adapted to incorporate a plurality of magnetic elements;

b. a second flexible strip 115, having a main axis, a first side 116 and a second side 117, with a plurality of cavities adapted to incorporate a plurality of magnetic elements;

c. a first wall 125 connectable to first side 111 of first strip 110, such that the plurality of magnetic elements of first strip 110 are embedded within the plurality of cavities between first strip 110 and first wall 125;

d. a second wall 127 connectable to first side 116 of second strip 115, such that the plurality of magnetic elements of second strip 115 are embedded within the plurality of cavities between second strip 115 and second wall 127.

As indicated by arrow 119, first and second strips 110 and 115 are adapted to be brought together from the side of the first and second walls 125 and 127, such that the magnetic elements and of first and the second strips 110 and 115 magnetically attract each other and a sealing is provided.

According to the embodiment of FIGS. 3-4, each of the first and the second walls 125 and 127 may be characterized by: (i) a predetermined thickness which substantially preserves the magnetic attraction capabilities of the plurality of magnetic elements and of first and second strips 110 and 115; and, (ii) a predetermined static friction coefficient which substantially prevents movement of first wall 125 with respect to second wall 127. When provided, the sealing may be stable to mechanical deformations of sealing device 120 relative to the main axis of first and second strips 110 and 115 due to the predetermined thickness and the predetermined static friction coefficients of first and second walls 125 and 127.

According to some embodiments, the predetermined thickness of each of first and second walls 125 and 127 is between about 0.05 mm to about 0.6 mm. According to other embodiments, the predetermined thickness of each of first and second walls 125 and 127 is about 0.2 mm. According to some embodiments, the predetermined static friction coefficient is between about 0.01 to about 0.99. According to other embodiments, the predetermined static friction coefficient is between about 0.1 to about 0.6. According to other embodiments, the predetermined static friction coefficient is about 0.5.

According to some embodiments, the plurality of cavities are equally spaced between each other at a distance of between about 2 mm to about 8 mm, such that each magnetic element within each cavity of the plurality of cavities is characterized by: a diameter of between about 4 mm to about 10 mm; and, a thickness of between about 1 to about 3 mm. According to other embodiments, first strip 110 and second strip 115 are characterized by a width of between about 10 mm to about 20 mm, and a thickness of about 1 to about 3 mm.

According to other embodiments, first and second walls 125 and 127 and first and second strips 110 and 115 are made of polymeric materials selected from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (AB S), polyacrylonitrile (PAN) or Acrylic, polybutadiene, poly (butylene terephthalate) (PBT), poly (ether sulfone) (PES, PES/PEES), poly(ether ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly (trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof.

According to different embodiments of the present invention, the magnetic elements are made of a material selected from the group consisting of: Neodymium, Neodymium Iron Boron (NdFeB), Samarium-Cobalt, Electromagnet, any other type of rare-earth magnet, and any combination thereof.

According to different embodiments, the mechanical deformations to which sealable device 120 is stable are selected from the group consisting of: bending, rotation, twisting, tilting, or any combination thereof.

According to different embodiments, when a sealing is provided by the magnetic strips of the present invention, sealable device 120 may be flexible and water impermeable.

According to the embodiments of FIGS. 3 and 4, first strip 110 and second strip 120 are locatable at an opening of sealable device 120.

According to different embodiments, first and second strips 110 and 115 are connectable to first and second walls 125 and 127 via a connecting means selected from the group consisting of: RF welding, ultrasonic welding, heat welding, sewing, via a seal tape, gluing, or any combination thereof.

According to different embodiments, sealable device 120 may be selected from the group consisting of: a pouch, a bag, a sack, a pocket, a device useful for sterile purposes, a door with a frame, a tent, a greenhouse, a waterproof pocket, or any combination thereof.

According to different embodiments, sealable device 120 may be usable in fields selected from the group consisting of: packaging, storage, military, medical, agriculture, food, outdoor activities, textile, fashion, or any combination thereof.

According to different embodiments, sealable device 120 may be used as a one way valve.

According to some embodiments, the plurality of cavities of first strip 110 and second strip 115 may be selected from the group consisting of: niches, recesses, pits, openings, holes, full openings, apertures, or any combination thereof. According to these embodiments, the a membrane may be connected to second sides 112 and/or 117 of first strip 110 and/or second strip 115.

According to different embodiments, sealing closure 120 may be manufactured according to a method selected from the group consisting of: extrusion, coextrusion, molding, or any combination thereof. The extrusion method may be used to: (i) provide continuous first and second strip; and, (ii) form a plurality of cavities within the first and second strips. The molding method may be used to provide the first strip and the second strip with the plurality of cavities according to a predetermined model.

According to different embodiments of the present invention, sealable device 120 may comprise an additional membrane which is adapted to be mechanically connected to at least one of first strip 110 and second strip 115 from the second side 112 and/or 117 of the same, when the plurality of cavities are full openings.

Figure 5:
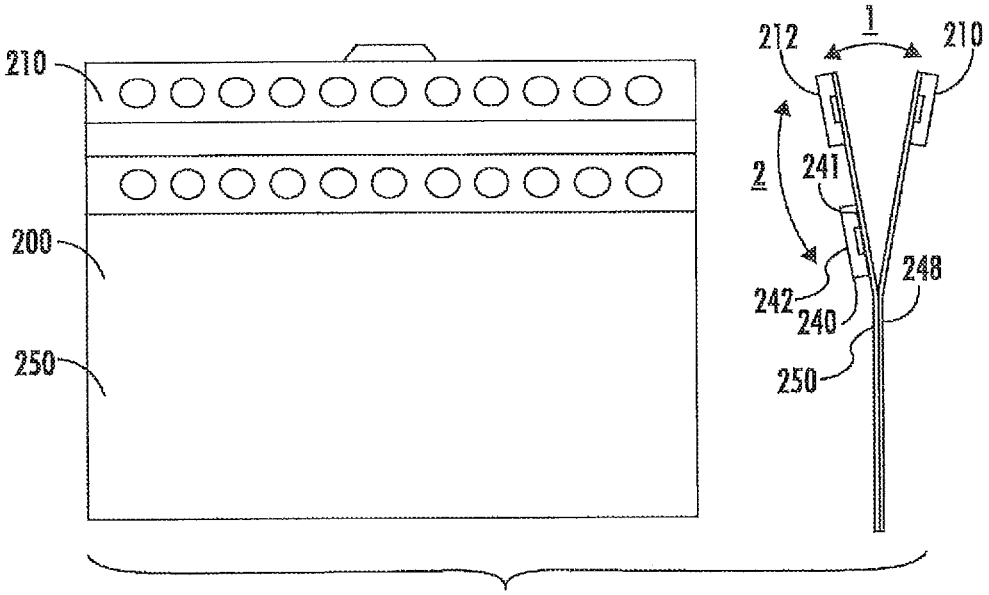
FIG. 5 is an illustration of another embodiment of the sealable device of the present invention.

Reference is now made to FIG. 5 in which another embodiment of the present invention is illustrated. According to this embodiment, an additional third magnetic element (e.g., magnetic strip 240) may be added to the sealable device of the present invention.

According to FIG. 5, third magnetic element is a third flexible strip 240, having a main axis, a first side 241 and a second side 242, with a plurality of cavities adapted to incorporate a plurality of magnetic elements. Third strip 240 is connectable to one of the second wall 250 (or to first wall 248), such that the plurality of magnetic elements of third strip 240 are embedded within the plurality of cavities between third strip 240 and one of second wall 250.

As illustrated in FIG. 5, the sealing which is provided by first and the second strips 210 and 212 is adapted to be bent towards the direction of third strip 240. The sealing of first and the second strips 210 and 212 is adapted to magnetically attract to second side 242 of third strip 240, so as to improve the sealing. The improvement of the sealing may be provided by at least two of the following effects: (i) the folding of sealable device provides an improvement the closure of the sealable device; (ii) the magnetic attraction of the magnetic elements of third strip 240 improves the magnetic attraction between the magnetic elements of the first and the second strips 210 and 212.

According to other embodiments of the present invention, the sealable device may comprise four or more magnetic strips with magnetic elements incorporated therein.

Figure 6A:
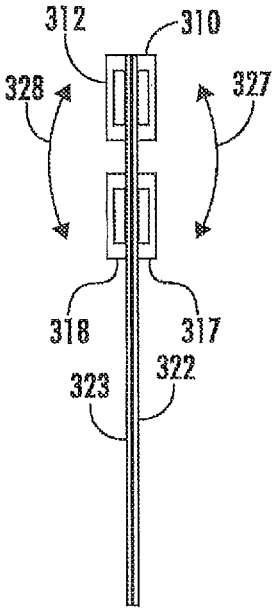
FIGS. 6A-B are illustrations of another embodiment of the sealable device of the present invention.
Figure 6B:
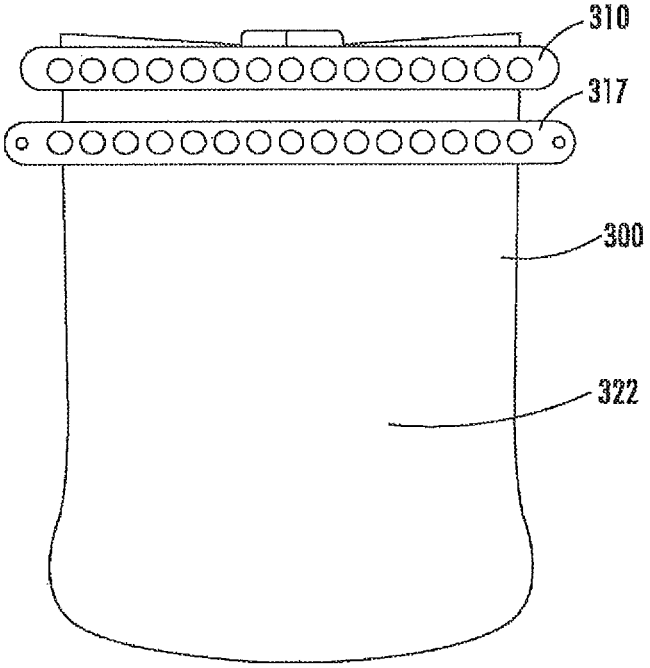

FIGS. 6A-B schematically illustrate an embodiment in which two pair of magnetic strips are illustrated. According to these figures, additionally two the first and the second strips 310 and 312, sealable device 300 further comprises the following elements:

a. a third flexible strip 317, having a main axis, a first side and a second side, with a plurality of cavities adapted to incorporate a plurality of magnetic elements. Third strip 317 is connectable to first wall 322, such that the plurality of magnetic elements of third strip 317 are embedded within the plurality of cavities between third strip 317 and first wall 322;

b. a fourth flexible strip 318, having a main axis, a first side and a second side, with a plurality of cavities adapted to incorporate a plurality of magnetic elements, the fourth strip 318 is connectable to second wall 323, such that the plurality of magnetic elements of fourth strip 318 are embedded within the plurality of cavities between fourth strip 318 and second wall 323.

As illustrated in FIGS. 6A-B, third and fourth strips 317 and 318 and are adapted to be brought together from the side of first and second walls 322 and 323, such that the magnetic elements of the third and the fourth strips magnetically attract each other and a sealing is provided.

According to FIGS. 6A-B, third strip 317 is parallel to first strip 310, and second strip 318 is parallel to fourth strip 312.

As indicated by arrows 327 and 328, the sealing of first and second strips 310 and 312 is adapted to be bent towards the direction of one of the: the second side of third strip 317 or the second of fourth strip 318. The sealing of first and second strips 310 and 312 is adapted to magnetically attract to one of the: the second side of third strip 317 or the second the of fourth strip 318, so as to improve the sealing. The improvement of the sealing may be provided by at least two of the following effects: (i) the folding of sealable device provides an improvement the closure of the sealable device; (ii) the magnetic attraction of the magnetic elements of third strip 317 and/or fourth strip 318 improves the magnetic attraction between the magnetic elements of the first and the second strips 310 and 312; (iii) the existence of two pair of magnetic strips, each of which provides a sealing closure, improves the overall sealing effect provided to sealable device 300.

According to the embodiments of FIGS. 3-6, the sealable device of the present invention is a pouch.

According to the some embodiments, the sealing closure of the present invention may be incorporated within a sealable device which is according to the embodiment is a pouch. The sealing closure of the present invention is adapted to provide sealing to the internal cavity of sealable device. When sealing is provided by the sealing closure, sealable device is sealed.

For example, the first strip of the present invention may be mechanically connected to one portion (e.g., internal wall) of a sealable device via a first connecting means, and second strip of the present invention may be mechanically connectable to another portion (e.g., the other internal wall) of a sealable device via a second connecting means.

According to different embodiments of the present invention, the first and the second connecting means are selected from the group consisting of: RF welding, ultrasonic welding, heat welding, sewing, via a seal tape, gluing, or any combination thereof.

The ability of the present invention to present invention to provide stability of the sealing is highly important in various cases. For example, when the sealing closure is used as a pocket is a swimming suit, the sealing has to be preserved when the user is wearing the swimming suit, and the sealing closure is bent.

For example, as illustrated in FIG. 4, the sealing closure provided by first and second strips 110 and 115, is incorporated within sealable device 120. According to this embodiment, the first membrane and/or the second membrane are the walls 125 and 127 of sealable device 120.

According to some embodiments, the sealing closure of the present invention which is illustrated in FIG. 3 and FIG. 4, is a one way valve. As a one way valve, the sealing is opened by an actuated pressure within the sealing closure, and following that, the material (e.g., air) which is trapped within the valve goes out, and the sealing is closed again. For example, the one valve may be used in order to release an air which is trapped within the sealable device, while preventing water from entering within the device.

According to another embodiment of the present invention, the sealing closure may comprises a third strip with magnetic elements which are covered by a membrane (at one of the sides of the third strip). According to some embodiments, this strip with the magnetic elements and the membrane may be similar to one of the component of the sealable device. According to this embodiment, the magnets of the third strip are attracted to the magnets of the second strip and/or the first strip, and thereby improving the magnetic attraction between the magnets of the first and the second strips. Moreover, due to the folding of the first and the second strips when brought together, towards the third magnetic strip, the closure is improved, and the internal pressure on the sealing closure is reduces. The third magnetic strip with the magnetic elements and the membrane are be used to provide sustainability to high internal pressure (or other) forces within the sealable device, when the sealable device is folded.

According to different embodiment of the present invention, the sealing closure of the present invention may be manufactured via the following methods of manufacturing: extrusion, coextrusion, molding, pre-cut polymer sheeting, laminating, etc.

According to other embodiments, the present invention discloses a single magnetic strip 10 which may be used for various purposes which are known in the art (e.g., connection of various objects to each other, fastening purposes, etc.). For example, the single magnetic strip 10 (with the plurality of magnetic 18 encapsulated by a first membrane 19) may be used for: dry store of objects, storage of materials, tents, sealable structures and/or rooms, greenhouses, covering and/or isolation for long periods of time, medical purposes.

Figure 7:
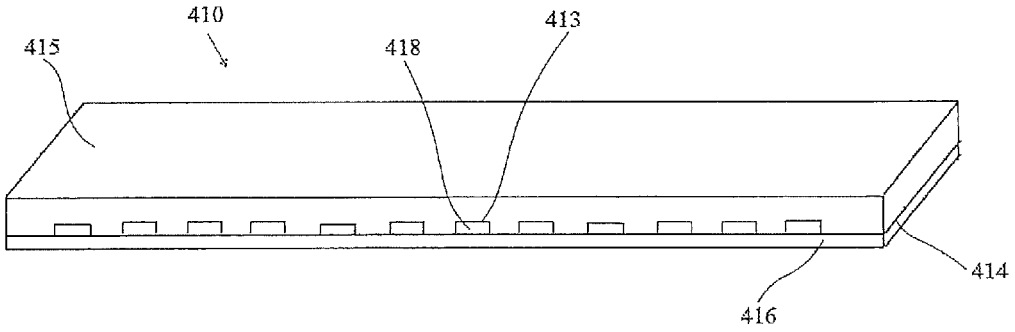
FIG. 7 is an illustration of another embodiment of the magnetic strip of the present invention.

Reference is now made to FIG. 7, which schematically illustrates a single magnetic strip 410 having a main axis, a first side 414 and a second side 415, with a plurality of cavities 413 adapted to accommodate a plurality of magnetic elements 418. The magnetic strip 410 further comprises membrane 416 connectable to first side 414 such that the plurality of magnetic elements 418 are embedded within the plurality of cavities 413 within single magnetic strip 410 and covered by membrane 416.

According to different embodiments, magnetic strip 410 is adapted to attract to a ferromagnetic material or a magnetic material from the side of first membrane 416.

According to different embodiments, magnetic strip 410 is adapted to magnetically attract to a curved surface while preserving the connection of the same along the length of the same.

According to different embodiments, first membrane 416 and is characterized by: (i) a predetermined thickness which substantially preserves the magnetic attraction capabilities of the plurality of magnetic elements of the first strip; and, (ii) a predetermined static friction coefficient which substantially prevents movement of the first membrane with respect to a material to which the magnetic elements are attracted.

According to different embodiments, the predetermined thickness of first membrane 416 is between about 0.05 mm to about 0.6 mm. According to other embodiments, the predetermined thickness of first membrane 416 is about 0.2 mm. According to different embodiments, the predetermined static friction coefficient is between about 0.01 to about 0.99. According to other embodiments, the predetermined static friction coefficient is between about 0.1 to about 0.6. According to other embodiments, the predetermined static friction coefficient is about 0.5.

According to some embodiments, the plurality of cavities are equally spaced between each other at a distance of between about 2 mm to about 8 mm, such that each magnetic element within each cavity of the plurality of cavities is characterized by: a diameter of between about 4 mm to about 10 mm; and, a thickness of between about 1 to about 3 mm.

According to some embodiments, first strip 412 is characterized by a width of between about 10 mm to about 20 mm, and a thickness of about 1 to about 3 mm.

According to some embodiments, first membrane 416 and first strip 412 may be made of polymeric materials selected from a group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ether ketone)s (PEEK, PES/PEEK), polyethylene (PE), poly(ethylene glycol) (PEG), poly (ethylene terephthalate) (PET), polypropylene (PP), polytetrafluoroethylene (PTFE), styrene-acrylonitrile resin (SAN), poly(trimethylene terephthalate) (PTT), polyurethane (PU), polyvinyl butyral (PVB), polyvinylchloride (PVC), polyvinylidenedifluoride (PVDF), poly(vinyl pyrrolidone) (PVP), or any combination thereof.

According to some embodiments, the magnetic elements may be made of a material selected from the group consisting of: Neodymium, Neodymium Iron Boron (NdFeB), Samarium-Cobalt, Electromagnet, any other type of rare-earth magnet, and any combination thereof.

According to some embodiments, magnetic strip 410 may be stable to mechanical deformations selected from the group consisting of: bending, rotation, twisting, tilting, or any combination thereof.

According to some embodiments, magnetic strip 410 may be flexible and water impermeable.

According to some embodiments, magnetic strip 410 may be used within a sealable device, such that when magnetic strip 410 is attracted to another ferromagnetic or magnetic element, the sealable device is sealed.

According to some embodiments first strip 412 is mechanically connectable to one portion of the sealable device via a first connecting means. The one portion may be located at an opening of the sealable device, and the first connecting means may be selected from the group consisting of: RF welding, ultrasonic welding, heat welding, sewing, via a seal tape, gluing, or any combination thereof.

According to some embodiments, the one portion is the first membrane.

According to some embodiments, the sealable device is selected from the group consisting of: a pouch, a bag, a sack, a pocket, a device useful for sterile purposes, a door with a frame, a tent, a greenhouse, a waterproof pocket, or any combination thereof.

According to some embodiments, the sealing closure which may be provided by magnetic strip 410 is usable in fields selected from the group consisting of: packaging, storage, military, medical, agriculture, food, outdoor activities, textile, fashion, or any combination thereof.

According to some embodiments, the sealing closure which may be provided by magnetic strip 410 is a one way valve.

According to some embodiments, the plurality of cavities of first strip 412 may be selected from the group consisting of: niches, recesses, pits, openings, holes, full openings, apertures, or any combination thereof.

According to some embodiments, magnetic strip 410 may additionally comprise a second membrane connectable to the second side of first strip 412, such that the plurality of magnetic elements of the first strip are embedded within the plurality of cavities between the first strip and the second membrane.

According to some embodiments, the sealing closure is manufactured according to a method selected from the group consisting of: extrusion, coextrusion, molding, or any combination thereof.

According to some embodiments, the extrusion method is adapted to: (i) provide continuous first strip; and, (ii) form a plurality of cavities within the first strip.

According to some embodiments, the molding method is adapted to provide the first strip with the plurality of cavities according to a predetermined model.

According to some embodiments, the magnetic strip further comprises a coating adapted to be mechanically connected to the first strip from the second side of the same, when the plurality of cavities are full openings.

Figure 8A:
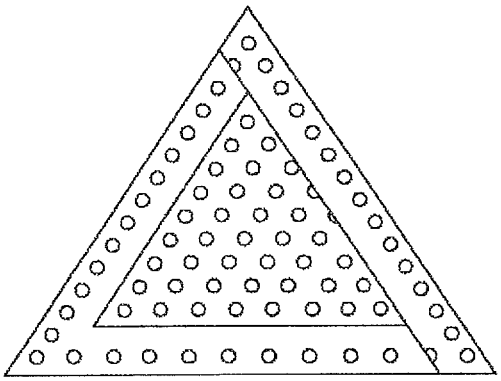
FIGS. 8A-C are illustrations of different embodiments of the geometrical structure of the strip according to the present invention.
Figure 8B:
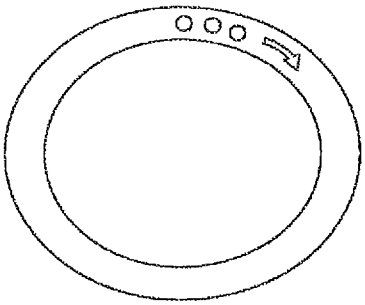
Figure 8C:
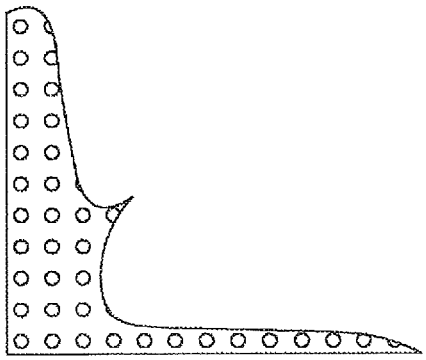

Reference is now made to FIGS. 8A-C, which schematically illustrate the different embodiments according to which the strip of the present invention may be manufactured. According to these embodiments, the strip of the present invention may be characterized by any known in the art geometrical structure, shape or dimensions (1D, 2D, or 3D) such as: rectangular, oval, or any other known the art geometrical structure. As can be seen in these figures, the arrangement of the magnetic elements with the magnetic strip of the present invention may be provided according to different patters (according to the different needs).

The sealing closure of the present invention can be manufactured according to the following steps:

a. Providing (i) a first flexible strip, having a main axis, a first side and a second side, with a plurality of cavities adapted to incorporate a plurality of magnetic elements; and, (ii) a second flexible strip, having a main axis, a first side and a second side, with a plurality of cavities adapted to incorporate a plurality of magnetic elements.
b. Inserting the plurality of magnetic elements within the plurality of cavities of the first and the second strips.
c. Connecting a first membrane to the first side of the first strip, thereby embedding the plurality of magnetic elements of the first strip within the plurality of cavities between the first strip and the first membrane.
d. Connecting a second membrane to the first side of the second strip, thereby embedding the plurality of magnetic elements of the second strip within the plurality of cavities between the second strip and the second membrane. Each one of the first and the second membranes is characterized by: (i) a predetermined thickness which substantially preserves the magnetic attraction capabilities of the plurality of magnetic elements of the first and the second strips; and, (ii) a predetermined static friction coefficient;
e. Bringing together the first strip and the second strip from the side of the first and second membranes, and magnetically attracting the magnetic elements of the first strip and the second strip to each other, thereby providing a sealing.

According to different embodiment of the present invention, the first and the second strips of the present invention may be manufactured via an extrusion or a molding method.

If the sealing closure is manufactured in the extrusion method, the method comprises additional steps of: (i) producing a continuous first and second strips; and, (ii) forming the plurality of cavities within the first strip and the second strip. According to some embodiments, in the extrusion process, which may be fully automated, cavities are formed within the strips, and magnets are inserted within the strips only after that. The process of forming the cavities may be performed by a punching machine which creates openings (two-sided openings), or by a pressure machine.

If the sealing closure is manufactured in the molding method, the method comprises an additional step of: producing a strip with the plurality of cavities according to a predetermine model.

The method of manufacturing a sealing closure further comprises a step of providing the first membrane and the second membrane with the predetermined thickness of between about 0.05 mm to about 0.6 mm.

Reference is now made to a method of manufacturing a sealable device, said device comprising a magnetic sealing closure having a. a first flexible strip, having a main axis, a first side and a second side, with a plurality of cavities adapted to incorporate a plurality of magnetic elements;
b. a second flexible strip, having a main axis, a first side and a second side, with a plurality of cavities adapted to incorporate a plurality of magnetic elements;
c. a first wall connectable to said first side of said first strip, such that said plurality of magnetic elements of said first strip are embedded within said plurality of cavities between said first strip and said first wall;
d. a second wall connectable to said first side of said second strip, such that said plurality of magnetic elements of said second strip are embedded within said plurality of cavities between said second strip and said second wall;

wherein said first and second strips and are adapted to be brought together from the side of said first and second walls, such that said magnetic elements of said first and said second strips magnetically attract each other and a sealing is provided, The aforementioned method comprising steps of injecting in a single mould the body of the sealable device and the magnetic sealing closure and incorporating within said body said magnetic sealing closure during the mould casting process.

According to different embodiments of the present invention, the sealing closure is characterized by a characteristic selected from: gas proof, waterproof, designed for biological warfare, extremely flexible and splash proof.

According to different embodiments of the present invention, the sealing closure may be characterized by a predetermined length (e.g., 30 cm-50 meter), or a continuous length.

The present invention can also be used for: pockets in a swim wear for men or women, detached water resistant pouches for use in the water, waterproof pockets in military uniforms, waterproof pockets in outdoor recreation clothing, closing for tents/green houses, closing for long/short term, Temperature controlled, conditions (Dry storage), Temp/long term covers for vehicles or outdoors, medical use for keeping sterile tools air and gas tight, reusable seal for transporting sensitive goods, biochemical warfare protection gear, food industry as a reusable seal (like dog food bags), boating and water sports, detached or connected pouches, bags of all descriptions.

An additional advantage of the present invention is the easy opening of the sealing. In other words, the amount of power needed in order to open the sealing is relatively low. According to an experimental data, the power which is needed in order to separate two magnets is between about 0.5 Kg. to 1.1 Kg.

According to another experimental data which was obtained from experiment on the shear forces between the first and the second membranes of the sealing closure, the results are the following:

| No. of magnets | Shear forces (N) |
|---|---|
| 1 | 1.47 |
| 2 | 3.78 |
| 3 | 5.44 |
| 4 | 8.10 |
| 5 | 10.19 |
| 6 | 12.28 |
| 7 | 14.15 |
| 8 | 17.01 |
| 9 | 19.40 |
| 10 | 21.93 |
| 11 | 23.19 |
| 12 | 24.51 |
| 13 | 26.18 |
| 14 | 30.82 |
| 15 | 31.21 |

The invention claimed is:

1. A magnetic sealing closure, comprising:

a. a first flexible strip, having a main axis, a first side and a second side, with a plurality of cavities having a plurality of magnetic elements therein;
b. a second flexible strip, having a main axis, a first side and a second side, with a plurality of cavities having a plurality of magnetic elements therein;

c. a third flexible strip, having a main axis, a first side and a second side, with a plurality of cavities having a plurality of magnetic elements therein;

wherein said sealing closure further comprises a first membrane coupled to said first side of said first strip, such that said plurality of magnetic elements of said first strip are flush mounted and embedded within said plurality of cavities between said first strip and said first membrane, said first membrane further coupled to said first side of said third strip, such that said plurality of magnetic elements of said third strip are flush mounted and embedded within said plurality of cavities between said third strip and said first membrane; and, said sealing closure further comprises a second membrane coupled to said first side of said second strip, such that said plurality of magnetic elements of said second strip are flush mounted and embedded within said plurality of cavities between said second strip and said second membrane; wherein said first and said second strips provide a first seal when said first and said second strips are brought together from said first sides of said first and said second strips and magnetic elements of said first and said second strips magnetically attract each other, wherein said first and said third strips provide a second seal when said first, said second, and said third strips are subsequently brought together from said second sides of said first and said third strips and magnetic elements of said first and said third strips magnetically attract each other.

2. The magnetic sealing closure of claim 1, wherein each of said membranes have a predetermined static friction coefficient which substantially prevents movement of said membranes with respect to each other.

3. The magnetic sealing closure of claim 1, wherein said membranes are walls of a sealable device.

4. The magnetic sealing closure of claim 1, wherein said magnetic elements of said strips comprise a material selected from the group consisting of: Neodymium, Neodymium Iron Boron (NdFeB), Samarium-Cobalt, or Electromagnet.

5. The magnetic sealing closure of claim 1, wherein said first seal is stable to mechanical deformations selected from the group consisting of: bending, rotation, twisting, and/or tilting.

6. The magnetic sealing closure of claim 1, wherein said first seal is flexible and water impermeable.

7. The magnetic sealing closure of claim 1, wherein said strips and said membranes are sealingly connected via mechanical connection means, and wherein said mechanical connection means are selected from the group consisting of: RF welding, ultrasonic welding, heat welding, sewing, via a seal tape, or gluing.

8. The magnetic sealing closure of claim 1, wherein said sealing closure is incorporated in a sealable device which is selected from the group consisting of: a pouch, a bag, a sack, a pocket, a device useful for sterile purposes, a door with a frame, a tent, a greenhouse, or a waterproof pocket.

9. The magnetic sealing closure of claim 1, wherein said sealing closure is usable in fields selected from the group consisting of: packaging, storage, military, medical, agriculture, food, outdoor activities, textile, or fashion.

10. The magnetic sealing closure of claim 1, wherein said plurality of cavities of said first strip, said second strip, and said third strip are selected from the group consisting of: niches, recesses, pits, openings, holes, full openings, or apertures.

11. The magnetic sealing closure of claim 1, wherein said sealing closure is manufactured according to a method selected from the group consisting of: extrusion, coextrusion, or molding.

12. The magnetic sealing closure of claim 11, wherein said extrusion method is adapted to: (i) provide continuous strips; and, (ii) form a plurality of cavities within said strips.

13. The magnetic sealing closure of claim 1, wherein said membranes each have a predetermined thickness of between 0.05 mm and 0.6 mm.

14. The magnetic sealing closure of claim 1, wherein said membranes each have a predetermined thickness of between 0.2 mm and 0.4 mm.

15. The magnetic sealing closure of claim 2, wherein said predetermined static friction coefficient of said membranes is between 0.01 and 0.99.

16. The magnetic sealing closure of claim 2, wherein said predetermined static friction coefficient of said membranes is between 0.1 and 0.6.

17. The magnetic sealing closure of claim 1, wherein said plurality of cavities of said strips are equally spaced between each other at a distance of between 2 mm and 8 mm, such that each magnetic element within each cavity of said plurality of cavities has a diameter of between 4 mm and 10 mm, and a thickness of between 1 mm and 3 mm.

18. The magnetic sealing closure of claim 1, wherein said first strip and said second strip have a width of between 10 mm and 20 mm, and further have a uniform predetermined thickness of between 1 mm and 3 mm.

19. The magnetic sealing closure of claim 1, wherein said membranes and said strips comprise polymeric materials selected from the group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ketone)s (PEEK, PES/PEEK), polyethylene (PE), polyethylene glycol) (PEG), poly (ethylene terephthalate) (PET), polypropylene (PP), polytetrafluoroethylene (PTFE), styrene-acrylonitrile resin (SAN), poly (trimethylene terephthalate) (PTT), polyurethane (PU), polyvinyl butyral (PVB), polyvinylchloride (PVC), polyvinylidenedifluoride (PVDF), or polyvinyl pyrrolidone (PVP).

* * * * *